US005468217A

United States Patent [19]

Garcia et al.

[11] Patent Number: 5,468,217

[45] Date of Patent: Nov. 21, 1995

[54] LOWER EXTREMITY PHLEBO PUMP

[75] Inventors: Mario C. Garcia, West St. Paul; Kristofer T. Lund, St. Paul; William H. Park, Sunfish Lake, all of Minn.

[73] Assignee: Prevent Products Inc., West St. Paul, Minn.

[21] Appl. No.: 207,301

[22] Filed: Mar. 7, 1994

[51] Int. Cl.[6] ..... A61H 1/00

[52] U.S. Cl. ..... 601/32; 601/27; 601/33

[58] Field of Search ..... 482/57, 60, 63–65, 482/79, 80, 907; 601/27, 29, 31–36

[56] References Cited

U.S. PATENT DOCUMENTS

| | | | |
|---|---|---|---|
| 3,318,304 | 5/1967 | Gurewich . | |
| 3,526,220 | 9/1970 | Small . | |
| 3,695,255 | 10/1972 | Rodgers et al. . | |
| 3,789,836 | 2/1974 | Girten . | |
| 3,917,261 | 7/1975 | Small et al. . | |
| 3,960,144 | 6/1976 | Simjian | 601/36 |
| 4,185,622 | 1/1980 | Swenson . | |
| 4,842,265 | 6/1989 | Kirk . | |
| 4,862,875 | 9/1989 | Heaton . | |
| 4,869,494 | 9/1989 | Lambert, Sr. | 482/60 |
| 5,284,131 | 2/1994 | Gray | 601/36 |
| 5,352,185 | 10/1994 | Blauth et al. | 482/79 |

FOREIGN PATENT DOCUMENTS

| | | | |
|---|---|---|---|
| 270734 | 6/1988 | European Pat. Off. | 601/31 |

OTHER PUBLICATIONS

"Pneumatic Compression Stockings–preventing Deep Vein thrombus and Pulmonary Embolus" Shick dated Jul. 1990 Autor: Anita D. Campbell, *Today's O.R. Nurse* ,pp. 4–9.

*Primary Examiner*—Richard J. Apley
*Assistant Examiner*—Jeanne M. Clark
*Attorney, Agent, or Firm*—Haugen & Nikolai

[57] ABSTRACT

An ankle calf exerciser/phlebo pump adapted to reduce the development of deep vein thromboses (DVT), leg edema, muscular atrophy and ankle joint stiffness in postoperative orthopedic patients. An efficient and simple driving mechanism is provided from imparting an alternating and reciprocating movement of a pair of foot paddles. The foot paddles are coupled to the driving mechanism such that only the patient's ankles will be flexed while the knee and hip remains stationary. This device is ideally suited for patients with hip fractures, and hip replacement with prosthesis. The speed of paddle reciprocation can be selected, as can the arcuate path of travel of the foot paddles by adjusting the length of a driving rod.

11 Claims, 4 Drawing Sheets

LOWER EXTREMITY PHLEBO PUMP

BACKGROUND OF THE INVENTION

I. Field of the Invention

This invention relates generally to an apparatus used for the therapeutic manipulation of a person's feet, and more particularly to an apparatus for stimulating blood flow in the legs and ankles to reduce the development of deep vein thromboses (DVT), leg edema, muscular atrophy and ankle joint stiffness in postoperative orthopedic patients.

II. Discussion of the Prior Art

Deep vein thromboses (DVT) occurs in approximately 50% of patients who undergo major orthopedic surgery. Pulmonary embolism (PE) is a potentially life-threatening complication of DVT. Studies show that general anesthetics, lengthy surgical operations, and vessel damage predispose the surgical candidate to venous thrombosis formation. To reduce incidents of deep vein thrombosis and subsequent pulmonary embolus, operative nurses should be proficient in detecting patients at risk for DVT through their perioperative nursing assessments. Options available for preventing DVT are individualized according to each patient's disease, degree of risk, and a period the patient is at risk.

Several methods of treatment are effective when a timely diagnosis is made. One treatment is immediate intravenous heparin therapy, which is continued for seven to ten days. Heparin does not dissolve the thrombus, but it does prevent the clot from enlarging. Warfarin sodium (Coumadin), an oral anti-coagulant, may be used instead of, or in conjunction with, heparin for perioperative anticoagulation therapy for orthopedic surgical patients. Warfarin may be given after the acute episode. It is used for up to six months to provide additional prophylaxis until risk factors have decreased. These patients are at greater potential risk for further episodes of PE.

Thrombolytic therapy successfully dissolves clots and is frequently used in treating hemodynamically comprised patients or those with significant cardiopulmonary disease. This modality includes the drugs streptokinase, urokinase, and tissue plasminogen activator.

The perioperative use of pneumatic compressive stockings and anti-coagulants is another available treatment for significantly reducing the incidents of DVT. These measures are initiated prior to anesthesia and before injury to any blood vessel occurs. Pneumatic stockings may also be initiated several hours or days before surgery. However, pneumatic stockings have been found to be uncomfortable, tending to decrease patient compliance. The drawbacks of using warfarin include bleeding complications, and the great expense for treatment compared to pneumatic compression. Pneumatic compression stockings are used until the patient is ambulating and using muscle action in the lower extremities to produce sufficient venous return.

It has been found that exercise increases blood flow to the distal extremities, and including those in which normal blood flow has been obstructed. Foot exercising devices having a pair of foot pads which undergo reciprocating motion are known to be useful in preventive treatment of thromboembolism of bed ridden patients. Such devices are known to be either motor driven or manually operated by the patient to derive the benefits of exercise. These prior art exercising devices suffer from being overly complicated in design, and/or they tend to unwantedly move the patient's leg and knee which can cause pain or degrade the effectiveness of the therapy of the patient's ankle.

One such foot exercising device is disclosed in U.S. Pat. No. 3,318,304. This device suffers in that the heel of the patient's foot is arcuately rotated about a fixed pivot point which causes the patient's knee to bend. Thus, this device cannot exercise the patient's ankle only without affecting flexure of the patient's knee. Other devices for stimulating the circulation of blood in the feet and legs are disclosed in U.S. Pat. Nos. 3,789,836 and 3,917,261.

OBJECTS

It is accordingly a principle object of the present invention to provide an improved ankle-calf exercise/phlebo pump for reducing the development of deep vein thrombosis (DVT), leg edema, muscular atrophy, and ankle joint stiffness in postoperative orthopedic patients.

Still yet a further object of the present invention is to provide an improved ankle-calf exerciser which exercises the ankle only, without flexure of the knee or hip.

Still yet another object of the present invention is to provide an improved ankle calf exerciser which requires a minimal number of parts, and is simple in design.

Another object of the present invention is to provide a ankle-calf exerciser which can be used by chair ridden or bed ridden patients, such as patients with hip fractures, or hip replacements with prosthesis.

Other objects, features and advantages of the present invention will become apparent to those skilled in the art through the Description of the Preferred Embodiment, Claims, and drawings herein wherein like numerals refer to like elements.

SUMMARY OF THE INVENTION

The foregoing objects and advantages of the present invention are achieved by providing an ankle-calf exerciser/phlebo pump with a pair of foot paddles or plates, each paddle including an integral cam which can be imparted for rotation about a common shaft. A lobed portion of each foot paddle cam is disposed on opposing sides of the common shaft from the other, and are coupled via a pair of elongated rods to a rotatable motor cam. Upon rotation of the motor cam, a reciprocating and alternating motion of the foot paddles is achieved. The foot paddle cams are disposed at a midsection thereof and proximate the heel portion of the foot paddle, thus, only the patient's ankle is flexed.

The foot exercise machine of the present invention includes a support housing, and a motor carried by the support and having a first rotatable cam. A shaft laterally extending between a first and second end is supported by this support. A pair of foot pads are each journaled for rotation thereabout, one at each end of the shaft. Each foot pad has a heel and toe portion for supporting a foot of the user. Each of the foot pads has an integral second cam which is coaxially disposed about the shaft. A pair of elongated drive or rod members are provided, each member having one end rotatably coupled to the motor first cam. In the preferred embodiment, the drive members are each rotatably coupled to the motor first cam at a common point. The opposing end of each drive member is rotatably coupled to one of the foot pad second cams. The pair of drive members are rotatably coupled to the foot pad second cams on opposite sides of the laterally extending shaft. Accordingly, rotation of the motor first cam imparts reciprocating rotation of each foot pad, out-of-phase with the other in opposite directions.

Each foot pad includes a cylindrical support portion located between the respective second cam and the foot pad. This cylindrical support is rotatably supported by the apparatus housing or support. The motor has a selectable speed feature to effect a selectable reciprocation frequency of the pair of foot pads. The foot pads second cams are disposed at a midsection of the foot pads, but proximate the heel portion such that the heel and toe pivot about the shaft. In use, the exercise machine will cause flexure of only the user's ankle, thus leaving the leg and hip stationary.

The present invention is user friendly resulting in increased patient compliance, avoids daily blood drawings required of other forms of treatment, and has received a positive response from nurses. The present invention promotes early rehabilitation, and is cost effective compared to medications such as warfarin, and pneumatic compression. Both chair ridden and bed ridden patients, including patients with hip fractures and hip replacements with prosthesis, will appreciate the convenience and effectiveness of the present invention. The incidents of DVT is lowered, and the time required for rehabilitation is reduced.

DESCRIPTION OF THE PREFERRED EMBODIMENT

Figure 1:
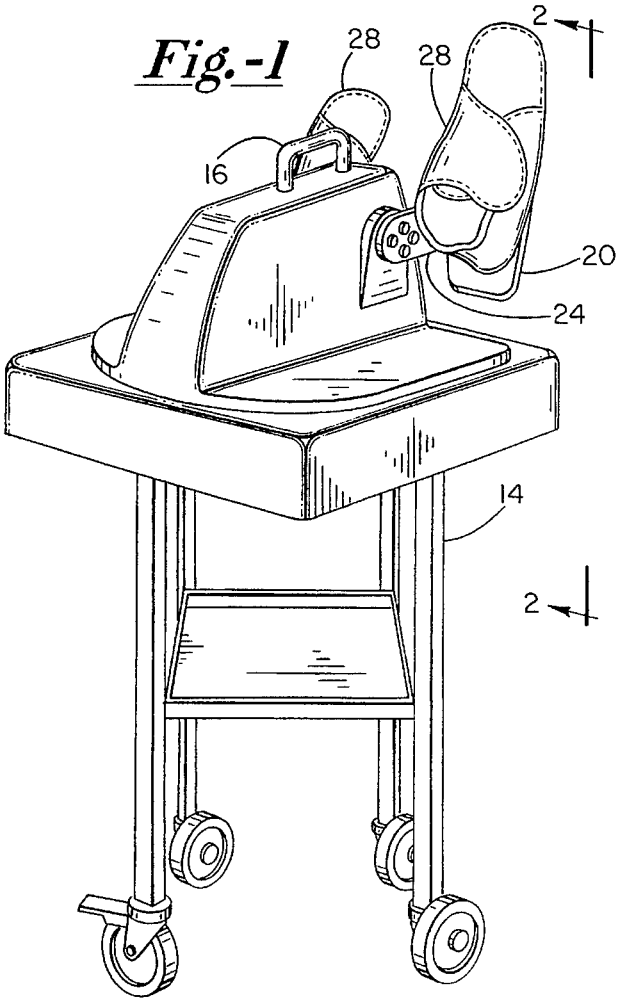
FIG. 1 is a perspective view of a cart mounted ankle-calf exerciser/phlebo pump according to the preferred embodiment of the present invention.

Referring now to FIG. 1, a perspective view of an ankle calf exerciser/phlebo pump is generally shown at 10. Exerciser 10 has a generally T-shaped housing 12 which can be supported upon a wheeled cart 14 for easy transport thereof if desired. Housing 12 includes a handle 16 extending upwardly from a top surface thereof to facilitate transport by hand, or to facilitate shifting the device upon a surface while orienting the device to the patient's feet for use. A pair of foot rest plates or paddles 20 are each rotatably supported by a respective, laterally extending shoulder portion 22 of housing 12. Shoulder 22 has a concentric opening with the paddle journaled for rotation therethrough. More particularly, each foot paddle 20 is seen to include an integral arm 24 perpendicularly extending from the inner side edge of the foot rest. These arms are rotatably coupled to and supported by the respective shoulder 22. Each foot paddle 20 is seen to include a slipper 28 fixedly mounted thereon, and which may include a Velcro® strap adapted to selectively secure a patient's foot to the respective foot paddle 20.

Figure 2:
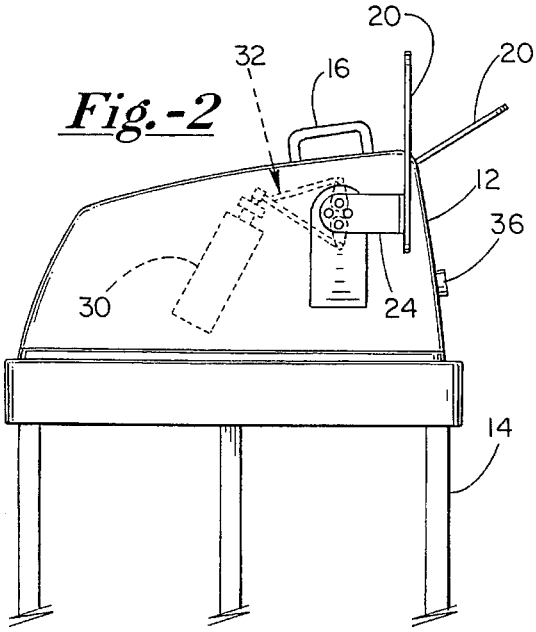
FIG. 2 is a side elevational view taken at 2—2 in FIG. 1 illustrating the orientation of the drive motor, and linkage assembly which imparts reciprocating and alternating motion of the pair of foot paddles.

Referring now to FIG. 2, a drive motor 30 is shown in phantom for imparting a reciprocating and alternating motion to each foot paddle 20. A pair of drive members 32 are each coupled to motor 30 at one end, and are coupled at an opposing end to one foot paddle arm 24 as will be discussed shortly in regards to FIG. 4. Motor 30 supported by, and positioned within, housing 12 to form a leverage point.

Figure 3:
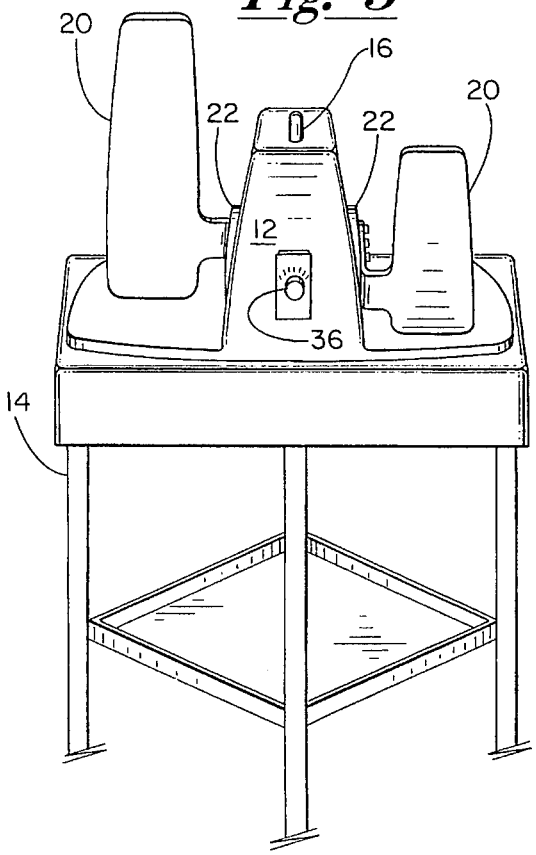
FIG. 3 is an end view of the present invention illustrating the drive mechanism being disposed between the foot plates, and having a speed selection switch accessible on the forward surface of the device.

Referring now to FIG. 3, an end view of exerciser 10 is shown. A speed select control knob 36 is provided at the front side of housing 12 to selectively set the operational speed of motor 30, and consequently the reciprocation frequency of paddles 20. Motor 30 is preferably comprised of a 1/26 horsepower 120 volt AC powered motor, wherein switch 36 comprises a variable potentiometer to effect the RPM setting.

Figure 4:
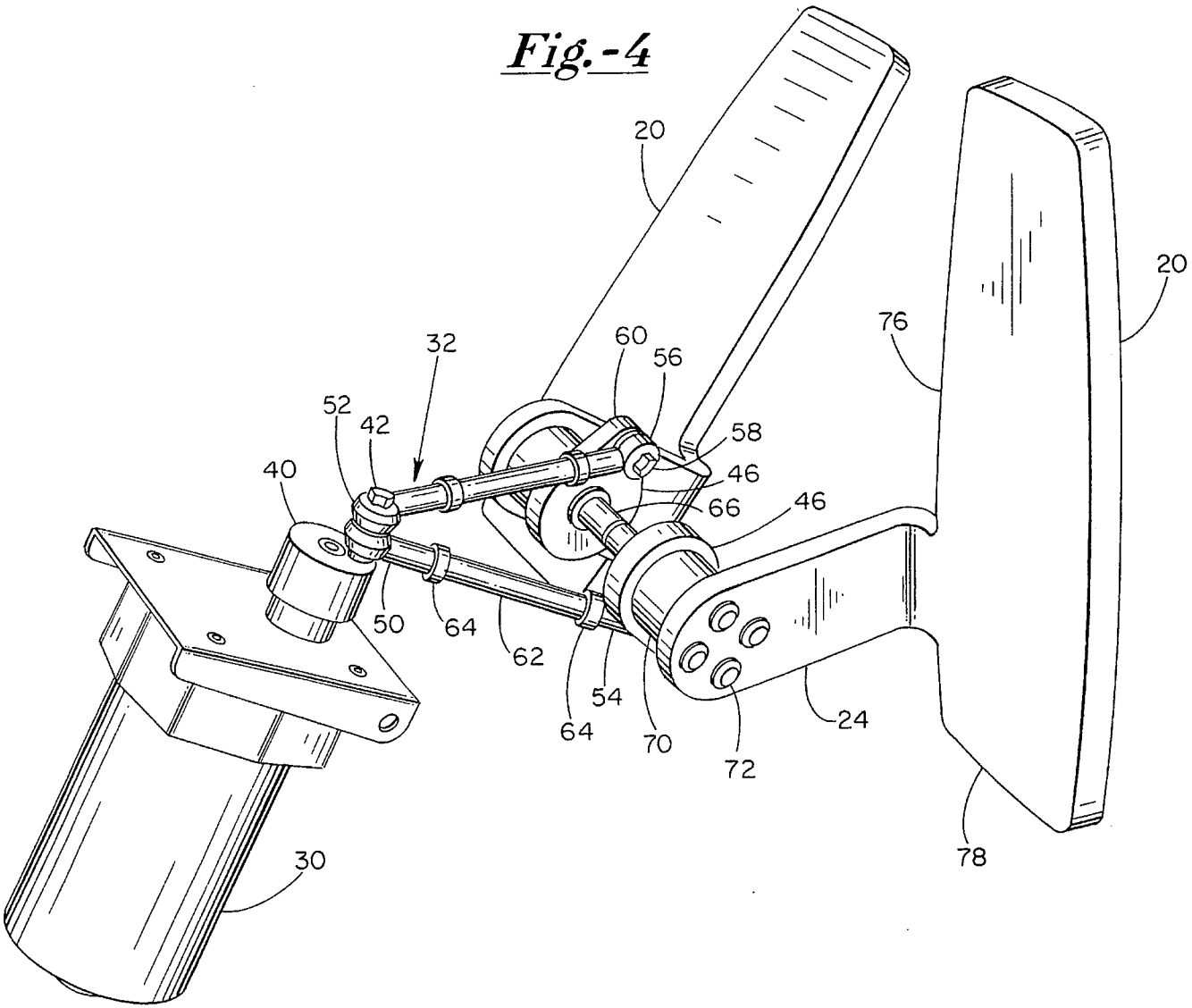
FIG. 4 is a perspective view of the drive motor, the driving linkages, and the foot paddles having integral cams which are rotatably reciprocated, in an alternating fashion, about a common laterally extending shaft.

Referring now to FIG. 4, a detailed view of the driving assembly for foot paddles 20 is shown. Motor 30, which is fixedly secured to and disposed within housing 12 as previously discussed, includes a rotatable cam 40 extending through the top end thereof. Cam 40 is driven by the motor and includes a bolt 42 disposed offset from, but parallel to, an axis of cam 40. Accordingly, bolt 42 travels a concentric circular path as cam 40 is rotated.

Each drive member 32 is comprised of a elongated rod coupled to, and extending between, cam bolt 42 and a respective foot paddle cam 46. A proximal end 50 of each member 32 is comprised of a flexible rubber swivel mount 52 having an opening defined therethrough for axially receiving bolt 42 as shown. A distal end 54 of each member 32 is also formed of flexible rubber, and includes a swivel mount 56 having an opening defined therethrough for receiving a fastening bolt 58. Bolt 58 secures the distal end 54 of member 32 to an integral lobed portion 60 of respective cam 46. A middle segment 62 of each member 32 is comprised of a rigid tubular material, such as aluminum. The midsection segment 62 can be of a selected length, and interchanged from sleeves 64 to affect the overall length of member 32, thus providing a fine adjustment for the arcuate path of travel of the respective foot pad 20.

Each cam 46 is journaled for rotation about a shaft 66 laterally extending between each cam member 46. Cam member 46 is also seen to include an integral cylindrical portion 70. Cylindrical portion 70 is rotatably supported by and disposed through shoulder 22 of housing 12, as previously discussed in reference to FIG. 1. Each foot paddle arm 24 is securingly connected to respective segment 70 via a plurality of bolts 72. The distal end of each arm 24 extends perpendicularly from an inside edge 76 of respective foot paddle 20 at a location proximate, but inward from, a heel portion 78 of paddle 20. Arm 24 is integral to foot paddle 20, as shown.

Also shown in FIG. 4 is the reciprocating and out-of-phase relationship of each foot paddle 20 to the other. Specifically, when the left paddle is extended to its maximum position in a clockwise direction, the other or right foot paddle 20 is rotated to its maximum counterclockwise position, as shown. This reciprocating and alternating relationship is established since the lobed portion 60 of each cam member 46 is disposed generally opposite the other about shaft 66, as shown. Thus, as motor cam 40 and bolt 42 are rotated 180 degrees from that position shown in FIG. 4, thus causing each member 32 to be motioned toward motor 30, the left cam 46 will rotate in the counterclockwise direction while the right cam 46 will rotate in the clockwise direction, where the converse applies.

In summary, motor 30 and each segment 70 of paddle cam member 46 are supported by housing 12. Cam members 46, including cylindrical portion 70, are secured to respective foot paddle 20 such that rotation of cam 46 imparts corresponding rotation of the respective foot paddle 20 about shaft 66.

Figure 5:
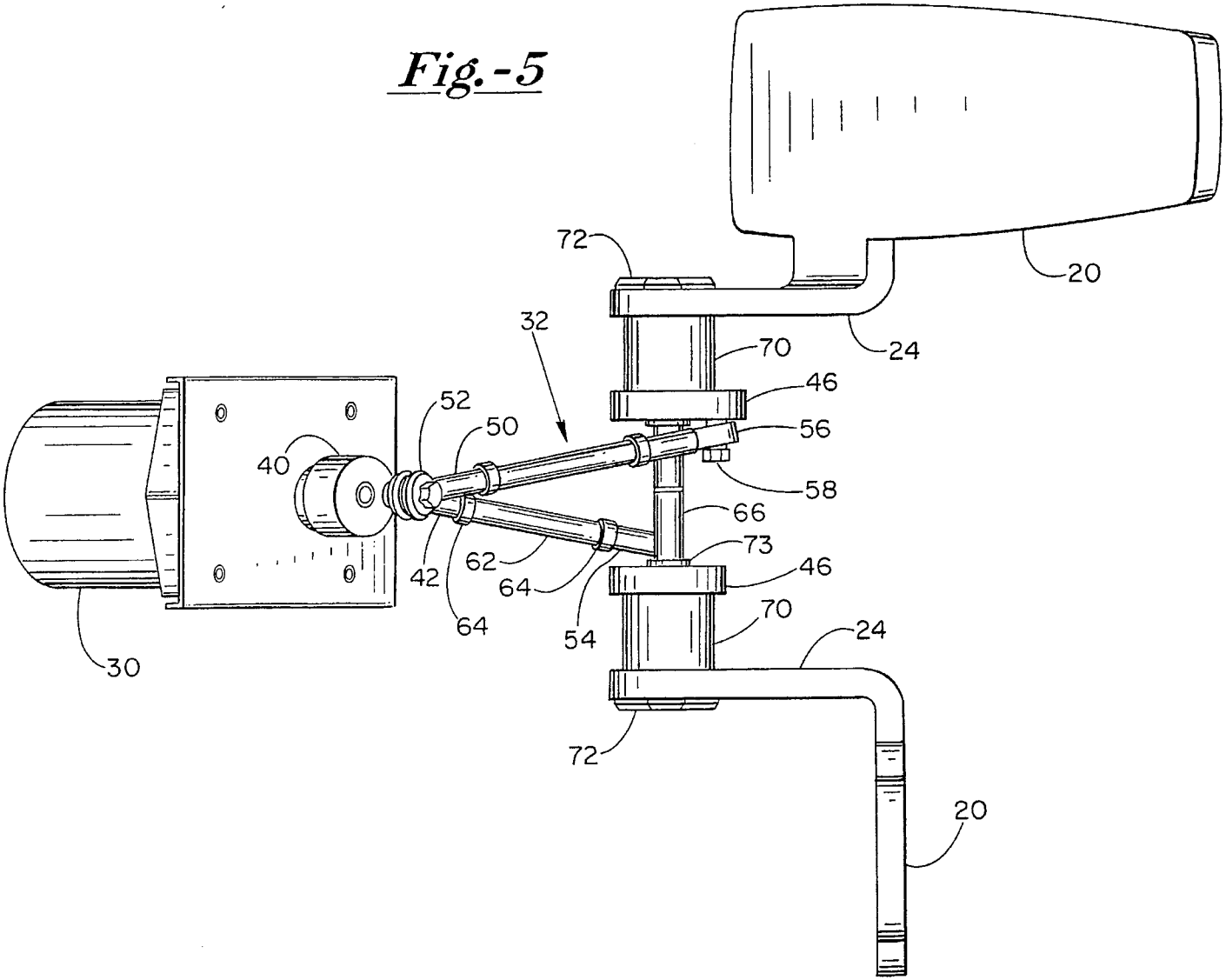
FIG. 5 is a top view of the driving mechanism illustrating the left foot pad fully extended in the clockwise direction, and the right foot pad fully rotated in the counterclockwise direction to a vertical orientation.

Referring now to FIG. 5, the relationship of each member 32 to one another and the respective foot paddle cams 46 can be seen. Specifically, when the left foot paddle 20 is fully rotated forwardly, as shown, the respective member 32 extends above pivot shaft 66 while the member 32 corresponding to the right foot paddle 20 is disposed under shaft 66, as shown. When motor cam 40 is rotated 180 degrees from that shown, thus rotating bolt 42 180 degrees, the left foot paddle will become vertical while the right foot peddle will be fully extended forwardly.

One key feature of the present invention is that the proximal end 50 of each member 32 includes the rubber swivel mount 52 and the distal swivel mount 56. Thus, the proximal and distal ends of each member 32 can flex slightly as cam 40 and bolt 42 rotate in a circular path. The ends of members 32 remain secured to the bolt 42 and respective bolt 58, but can rotate thereabout. These rubber swivel mounts allow each member 32 to be flexed slightly in the lateral direction without snapping. These rubber swivel mounts also electrically isolate the foot paddles 20 from motor 30. The rubber swivel mounts do not necessitate a high degree of tolerance for fitting these mechanical components to one another. Thus, the apparatus is easy to assemble, and properly functions without paying particular attention to the component tolerances.

In operation, motor 30 will operate to continuously rotate cam 40, and thus bolt 42, in the clockwise direction at a predetermined speed established by switch 36. As bolt 42 rotates in a circular path, each member 32, which are tied together at a common point by bolt 42, will be caused to impart in a corresponding longitudinal movement and reciprocate. Since each member 32 is rotatingly coupled to the corresponding foot paddle cam 46 by respective bolt 58, each cam 46 and consequently foot paddle 20 will correspondingly reciprocate therewith. Lobed portion 60 of each cam 46 extends radially outward from the axis of shaft 66 such that neither of members 32 will interfere with shaft 66 during rotation of each cam 46. Each cam 46 includes bearings at 73 to provide a smooth non-binding coupling of cam 42 about shaft 66. The particular path of travel of each foot paddle 20 can be selectively chosen by implementing segment 62 of a proper length. For instance, implementing a segment 62 longer in length from that shown will cause the left paddle to reside in a more horizontal position at one extreme while not achieving vertical when rotated to the other extreme.

Figure 6:
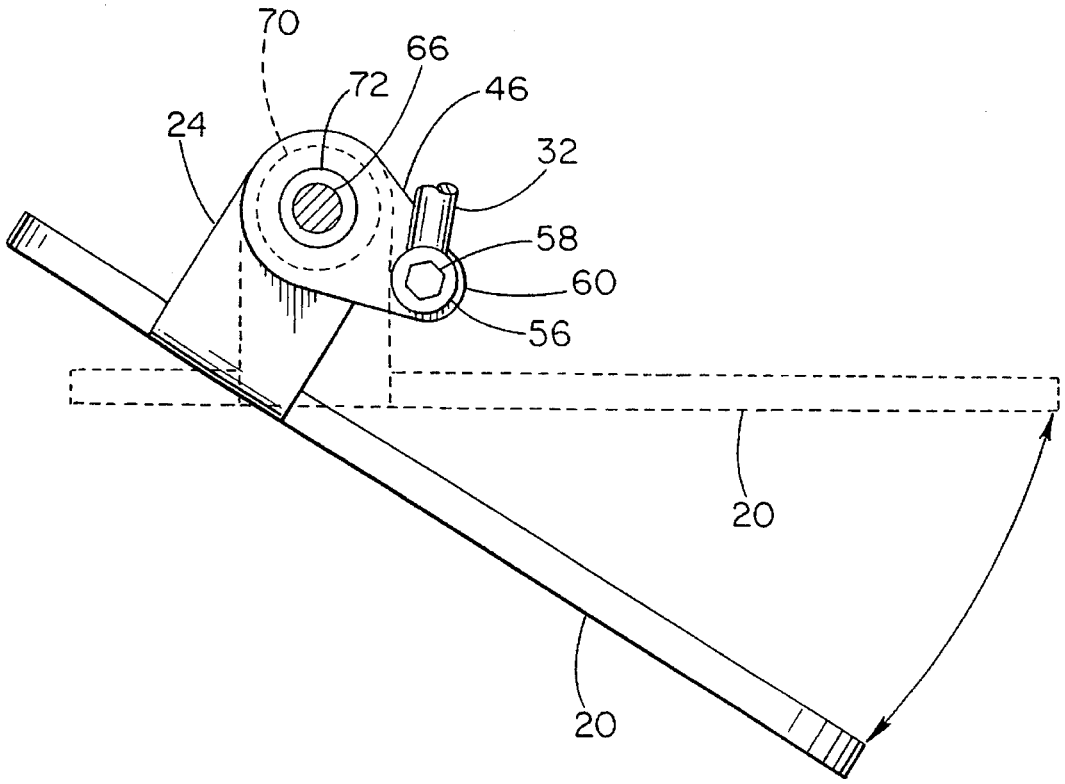
FIG. 6 is a partial sectional view of one foot pad illustrating the path of travel during reciprocation about the shaft, whereby a user's ankle remains stationary as the heel and toe are flexed about the ankle.

Referring now to FIG. 6, each foot paddle 20 can be seen to be rotated in phantom about an axis of pin 66 such that when a patient adapts one's foot thereto, only the ankle will be flexed, and the knee and hip will remain stationary. This is due to the fact that arm 24 extends from foot rest 20 at a midsection thereof, rather than from proximate the heel portion of member 20. The achilles heel of one's foot would be disposed proximate this arm 24.

In summary, a simple but effective driving mechanism is provided for reciprocating a pair of foot paddles. A minimal amount of parts are required to alternating reciprocate each of the foot members 20. Only a pair of linkages are required, each extending between motor 30 and the cams of the foot paddles. Each of these driving members has a rubber swivel mount at each end thereof to allow flexure of each member without snapping while imparted in a longitudinal movement. Thus, close tolerances of these parts is not required. The lengths of each driving member can be selectively defined by segments 62 to determine the arcuate path of travel of each foot paddle 20. The foot paddles reciprocate in an alternating relationship with one another. The arm of each foot paddle is coupled to the midsection of the foot rest such that only the ankle of the patient's foot is flexed. The speed of the motor 30 can be selected between 0 and 60 RPM, and is selectable by the patient or the physician. Slippers integrally disposed on each paddle 20 comfortably secure the patient's foot to the paddles for therapy.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

We claim:

1. A foot exercise machine, comprising:

(a) a support;

(b) a motor carried by said support and having a first rotatable cam;

(c) a shaft extending between a first and second end and supported by said support;

(d) a pair of foot pads, one foot pad journaled for rotation about each of said shaft ends, each foot pad having a heel and toe for supporting a foot of a patient, each said foot pads having an integral second cam coaxially disposed about said shaft;

(e) a pair of elongated drive members each having one end rotatably coupled to said motor first cam, and an opposing end rotatably coupled to one of each said foot pad second cams such that rotation of said motor first cam imparts rotation of each foot pad second cams about said shaft; and (f) said drive members are rotatably coupled to said motor first cam at a common point.

2. The foot exercise machine of claim 1 wherein said pair of drive members are rotatably coupled to said foot pad second cams on opposite sides of said shaft such that rotation of said motor first cam imparts reciprocating rotation of each said pair of foot pad second cams in opposite directions.

3. The foot exercise machine of claim 1 wherein each said foot pad has a cylindrical support portion disposed between said respective second cam and said foot pad, wherein said support portion is rotatably supported by said support.

4. The foot exercise machine of claim 1 wherein said motor has a selectable rotational speed and a control for selecting said speed.

5. The foot exercise machine of claim 1 wherein said foot pad second cams are disposed proximate a midsection of said foot pads such that said heel and toe pivot about said shaft axis to dorsiflex a patient's ankle without moving the patient's leg.

6. The foot exercise machine of claim 1 wherein said at least one end of said drive members is formed of a flexible material to allow flexure thereof.

7. The foot exercise machine of claim 6 wherein both said ends of said drive members are formed of a flexible material.

8. The foot exercise machine of claim 1 wherein said foot pads include a foot restraining shoe member.

9. The foot exercise machine of claim 1 wherein the length of said drive members is adjustable to allow angular adjustment of said foot pad rotation.

10. The foot exercise machine of claim 1 wherein each said foot pad includes a means for securing a patient's foot thereto.

11. The foot exercise machine of claim 10 wherein said securing means comprises a slipper.

* * * * *